US011040459B2

(12) United States Patent
Singer

(10) Patent No.: US 11,040,459 B2
(45) Date of Patent: Jun. 22, 2021

(54) KNIFE WITH EXTENDED HANDLE GRIP PORTION

(71) Applicant: Norman Singer, Beit Shemesh (IL)

(72) Inventor: Norman Singer, Beit Shemesh (IL)

(73) Assignee: Norman Singer, Beit Shemesh (IL)

( * ) Notice: Subject to any disclaimer, the term of this patent is extended or adjusted under 35 U.S.C. 154(b) by 0 days.

(21) Appl. No.: 16/026,799

(22) Filed: Jul. 3, 2018

(65) Prior Publication Data

US 2020/0009755 A1 Jan. 9, 2020

(51) Int. Cl.

| | |
|---|---|
| ***B26B 29/02*** | (2006.01) |
| ***B25G 1/10*** | (2006.01) |
| ***B26B 3/03*** | (2006.01) |

(52) U.S. Cl.

CPC ..... *B26B 29/02* (2013.01); *B25G 1/102* (2013.01); *B26B 3/03* (2013.01)

(58) Field of Classification Search

CPC ..... B25G 1/102; B25G 3/02; B26B 3/00–03; B26B 29/06; B26B 29/063

USPC ..... 30/123, 142, 147–149, 233, 235, 241, 30/228, 272.1, 277.4, 295, 329, 340, 30/342–344, 337, 320, 392, 296.1, 298, 30/312, 299–307; D7/646, 649, 650, 381, D7/385, 401.2; 452/161, 164, 132, 132.6; 16/110.1, 111.1, 431, 900, 445, 442, 430

See application file for complete search history.

(56) References Cited

U.S. PATENT DOCUMENTS

| | | | |
|---|---|---|---|
| 108,141 | A | 10/1870 | Houseman et al. |
| 165,841 | A | 7/1875 | Kellogg |
| 173,955 | A | 2/1876 | Hudson |
| 226,146 | A | 3/1880 | Zimmerer |
| 235,425 | A | 12/1880 | Gearon |
| 296,304 | A | 4/1884 | Allen |
| 369,314 | A | 9/1887 | Brougher |
| 391,268 | A | 10/1888 | Parker |
| 490,577 | A | 1/1893 | Memminger |

(Continued)

FOREIGN PATENT DOCUMENTS

| | | | |
|---|---|---|---|
| CN | 2052708 | U | 2/1990 |
| CN | 201573219 | U | 9/2010 |

(Continued)

OTHER PUBLICATIONS

Hilton Knife, http://www.candlepowerforums.com/vb/showthread.php?343017-Another-Spyderco-paramilitary-2-review, Aug. 23, 2012.

(Continued)

*Primary Examiner* — Jason Daniel Prone

(74) *Attorney, Agent, or Firm* — Pearl Cohen Zedek Latzer Baratz LLP

(57) ABSTRACT

A knife with an extended handle includes one side of the handle, either as part of the original structure or bonded or welded to that original structure, that projects or extends forward onto the base of the knife blade on one side thereof, thereby providing a gripping surface for the user's thumb, and onto or alongside the spine of the knife blade to provide a proximal phalanx platform for the user's forefinger. The spine may have a notch formed therein proximal, and wherein the finger platform rests in or alongside the notch. The finger platform may have a concave surface contour, and the concave surface contour may be coextensive with the notch.

19 Claims, 7 Drawing Sheets

(56) References Cited

U.S. PATENT DOCUMENTS

| | | | | |
|---|---|---|---|---|
| 492,409 | A | 2/1893 | May | |
| D22,439 | S | 5/1893 | McGuigan | |
| 538,459 | A | 4/1895 | McCausland | |
| 605,577 | A | 6/1898 | Hutchinson | |
| 649,059 | A | 5/1900 | Kern | |
| 673,506 | A | 5/1901 | Pitts | |
| 682,624 | A | 9/1901 | Klickman | |
| 682,938 | A | 9/1901 | Ingram | |
| 725,811 | A | 4/1903 | Asbell | |
| 983,736 | A | 2/1911 | Maconochie | |
| 1,118,507 | A | 11/1914 | Meyer | |
| 1,299,084 | A | 4/1919 | Wilson | |
| 1,333,960 | A | 3/1920 | Brehm | |
| 1,491,623 | A | 4/1924 | Pitchur | |
| 1,505,444 | A | 8/1924 | Swanson | |
| 1,571,886 | A | 2/1926 | North | |
| 1,602,032 | A | 10/1926 | March | |
| 1,750,577 | A | 3/1930 | De Bracht | |
| 1,967,479 | A | 7/1934 | Platts | |
| 2,153,759 | A | 4/1939 | Katzinger | |
| 2,168,237 | A | 8/1939 | Polacsek | |
| 2,217,100 | A | 10/1940 | Burns | |
| D131,224 | S | 1/1942 | Parisi | |
| 2,279,833 | A | 4/1942 | Madan | |
| 2,315,898 | A | 4/1943 | Krilow | |
| D136,023 | S | 7/1943 | Phillips | |
| 2,467,327 | A | 4/1949 | McKee | |
| 2,494,306 | A | 1/1950 | Morvey | |
| D173,124 | S | 9/1954 | Niblack | |
| 2,737,719 | A | 3/1956 | Ember et al. | |
| 2,739,498 | A | 3/1956 | Champlin | |
| D177,743 | S | 5/1956 | Marx | |
| 2,803,876 | A | 8/1957 | Nelson | |
| D202,780 | S | 11/1965 | Baer | |
| D235,841 | S | 7/1975 | Cremonese | |
| D239,623 | S | 4/1976 | Behunin | |
| D252,790 | S | 9/1979 | Reinschreiber | |
| 4,178,684 | A | 12/1979 | Mightly | |
| D255,974 | S | 7/1980 | Jacoby | |
| D262,731 | S | 1/1982 | Austin | |
| 4,578,864 | A | 4/1986 | Hoffman | |
| D306,957 | S | 4/1990 | Cohen et al. | |
| 5,251,380 | A * | 10/1993 | Craig | B25G 1/102 30/340 |
| 5,365,666 | A | 11/1994 | Gonzalez | |
| D372,635 | S | 8/1996 | Gebhardt | |
| D391,115 | S | 2/1998 | Roberton | |
| D397,282 | S | 8/1998 | Derkatz | |
| D405,338 | S | 2/1999 | Balolia | |
| 6,105,262 | A * | 8/2000 | Rickard | B26B 5/00 30/340 |
| D435,199 | S | 12/2000 | Cohen et al. | |
| D439,806 | S | 4/2001 | Juhlin et al. | |
| D445,643 | S | 7/2001 | Kazaklaris | |
| 6,254,293 | B1 * | 7/2001 | Citrenbaum | B43K 23/008 30/340 |
| D455,937 | S | 4/2002 | Huebner | |
| D461,681 | S | 8/2002 | Lothe | |
| D461,688 | S | 8/2002 | Lothe | |
| 6,502,314 | B1 | 1/2003 | McCatty | |
| 6,701,624 | B1 | 3/2004 | White | |
| 6,725,545 | B2 | 4/2004 | Frank | |
| D537,850 | S | 3/2007 | Moore et al. | |
| D538,591 | S | 3/2007 | Aston, III | |
| D539,082 | S | 3/2007 | Molayem | |
| D539,086 | S | 3/2007 | Aston, III | |
| D546,134 | S | 7/2007 | Leuze | |
| D552,430 | S | 10/2007 | Chen | |
| 7,284,300 | B1 * | 10/2007 | Bruns | B25G 1/102 16/110.1 |
| D554,949 | S | 11/2007 | Hood | |
| 7,302,760 | B2 | 12/2007 | Lake | |
| 7,434,320 | B2 | 10/2008 | Aston, III | |
| D600,506 | S | 9/2009 | Miltner et al. | |
| D612,694 | S | 3/2010 | Eide et al. | |
| D624,369 | S | 9/2010 | Gerlach | |
| 7,930,804 | B2 * | 4/2011 | Cornfield | B25G 1/102 16/DIG. 18 |
| D643,256 | S | 8/2011 | Hirai | |
| D643,257 | S | 8/2011 | Hirai | |
| D643,260 | S | 8/2011 | Spiegel | |
| D643,261 | S | 8/2011 | Spiegel | |
| 8,082,669 | B2 | 12/2011 | Hayes | |
| D661,554 | S | 6/2012 | Thomkins | |
| D677,551 | S | 3/2013 | Pelton | |
| 8,584,365 | B2 | 11/2013 | Zeitlin | |
| 8,707,490 | B1 | 4/2014 | Pelton | |
| 8,732,958 | B2 | 5/2014 | Huang | |
| D710,158 | S | 8/2014 | Berger | |
| 8,839,524 | B2 * | 9/2014 | Owens | B26B 3/00 30/340 |
| D717,127 | S | 11/2014 | Chen | |
| D719,405 | S | 12/2014 | Miller | |
| 8,931,381 | B2 | 1/2015 | Poran | |
| 8,943,935 | B2 | 2/2015 | Qian | |
| 9,132,559 | B2 | 9/2015 | Hatch et al. | |
| D750,948 | S | 3/2016 | Pelton | |
| D766,672 | S | 9/2016 | Mishan | |
| D766,673 | S | 9/2016 | Mishan | |
| D766,674 | S | 9/2016 | Mishan | |
| D770,849 | S | 11/2016 | De la Coussaye | |
| D774,354 | S | 12/2016 | Scobey, Jr. | |
| D781,666 | S * | 3/2017 | Mishan | D7/649 |
| D790,287 | S * | 6/2017 | Singer | D7/649 |
| D790,288 | S * | 6/2017 | Singer | D7/649 |
| D790,289 | S * | 6/2017 | Singer | D7/649 |
| D790,290 | S * | 6/2017 | Singer | D7/649 |
| D792,154 | S | 7/2017 | Berger | |
| D795,639 | S * | 8/2017 | Singer | D7/401.2 |
| D803,012 | S * | 11/2017 | Singer | D7/649 |
| D810,517 | S * | 2/2018 | Singer | D7/649 |
| 9,889,573 | B2 * | 2/2018 | Singer | B26B 3/00 |
| D812,435 | S * | 3/2018 | Singer | D7/649 |
| D904,833 | S * | 12/2020 | Singer | D7/649 |
| 2002/0170184 | A1 | 11/2002 | Lothe | |
| 2003/0182808 | A1 | 10/2003 | Mireles | |
| 2005/0241111 | A1 | 11/2005 | Prokop | |
| 2006/0032059 | A1 * | 2/2006 | Corwin | B25G 1/102 30/340 |
| 2010/0263218 | A1 * | 10/2010 | Bookhamer | B26B 3/02 30/340 |
| 2010/0325901 | A1 | 12/2010 | Catalano | |
| 2012/0159793 | A1 | 6/2012 | Hatch et al. | |
| 2013/0104403 | A1 | 5/2013 | Stokes | |
| 2013/0280997 | A1 * | 10/2013 | Ramos | B26B 3/00 30/294 |
| 2014/0317940 | A1 * | 10/2014 | Scobie | B26B 9/00 30/346 |
| 2015/0026987 | A1 * | 1/2015 | Chiang | B26B 3/00 30/340 |
| 2016/0193742 | A1 | 7/2016 | Faiola | |
| 2016/0375598 | A1 | 12/2016 | Singer | |
| 2018/0169852 | A1 * | 6/2018 | Fryer-Biggs | B25G 1/102 |
| 2019/0193291 | A1 * | 6/2019 | Rose | B25G 1/102 |

FOREIGN PATENT DOCUMENTS

| | | | | |
|---|---|---|---|---|
| CN | 202062384 | U | 12/2011 | |
| CN | 302464750 | | 6/2013 | |
| DE | 29914226 | U1 | 11/1999 | |
| FR | 2600574 | A1 | 12/1987 | |
| JP | D1485597 | | 12/2013 | |
| KR | 2003-50421 | Y1 | 5/2004 | |
| KR | 20090007796 | U | 8/2009 | |
| WO | WO-2020008265 | A3 * | 4/2020 | B26B 3/03 |

OTHER PUBLICATIONS

Jade Knife, http://andy321.proboards.com/thread/50295/jade-knife, Feb. 1, 2012.

Tac-Force TF-578BK Karambit A/O Finger Ring Knife, http://www.moosecreekgear.com/tac-force-tf578bk-karambit-ao-linerlock-knife.html, last accessed Jun. 25, 2015.

(56) References Cited

OTHER PUBLICATIONS

Gerber Myth Pocket Folder Knife, http://www.amazon.com/Gerber-Myth-Pocket-Folder-Knife/dp/B00P6M07B4, last accessed Jun. 25, 2015.
High Desert Survival School Knife, http://jasonklass.blogspot.in/2011/05/high-desert-survival-school-knife.html, last accessed Jun. 25, 2015.
International Search Report of PCT Application No. PCT/IB19/00844, dated Feb. 25, 2020.

* cited by examiner

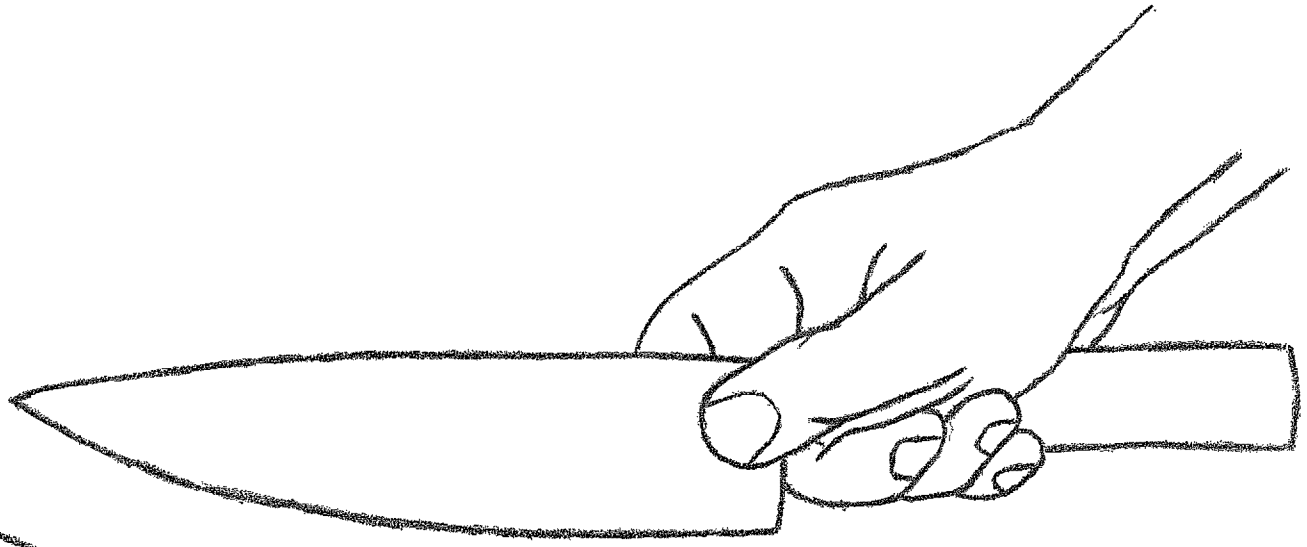
FIG. 2A
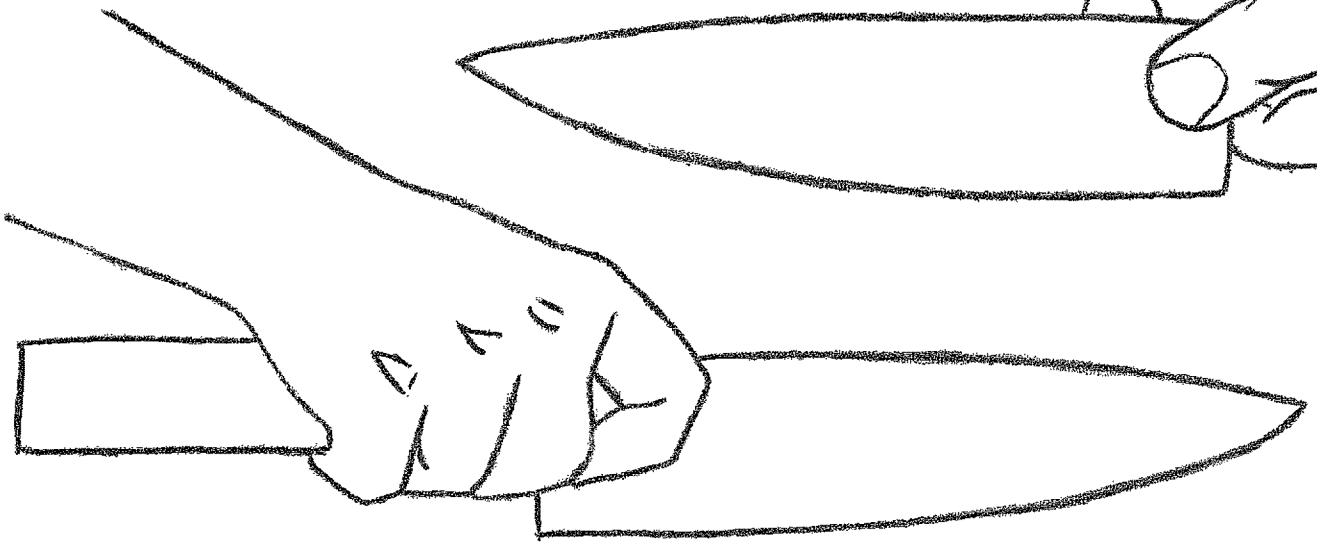
FIG. 2B
FIG. 2
PRIOR ART

KNIFE WITH EXTENDED HANDLE GRIP PORTION

FIELD OF THE INVENTION

The present invention relates generally to the field of handheld tools, such as knives, and more particularly to a system and apparatus for improving the maneuverability, grip, and control of a handheld tool such as a knife.

BACKGROUND OF THE INVENTION

The safe and effective use of handheld tools such as knives requires a firm grip and precise control, and the ability to control the motion of a knife has a direct effect upon its safety and usefulness. Control and precision are especially important when using a knife or other sharp tool in an environment where a risk of injury is present, such as when used by chefs and others in the culinary arts.

Handle designs for knives have evolved over the years to provide the user with improved control. Features such as finger grips and curved handle shapes have improved the grip of various types of knives. Many knives, for example, include a bolster or guard at the end of the handle, next to the blade, to prevent the user's hand from slipping onto the blade during use. Other knife designs include a small platform on the top of the bolster or spine of the knife for support of the user's forefinger, which enables the user to apply a greater downward cutting force. Such platforms, however, assist the user only when pressing the knife in the downward direction. Additionally, the forefinger typically needs to stretch to its full extension in order to rest on the platform, a position that may cause stress to the joints with extended use.

Advanced cutting techniques have also evolved in order to improve the utility and safety of knives. There are a variety of different ways to grip a knife during food preparation, and some grips are better for particular situations than others. For example, because many tasks in the culinary arts require precise control of a handheld tool, chefs sometimes pinch the back end of a knife blade with their thumbs and forefingers when chopping or dicing foods.

For example, when chopping or slicing food items in what is known as "the pinch grip" or "the chef's grip", a user may grip the knife by pinching the base of the blade with the thumb and forefinger on the two sides or faces, while the remaining parts of the hand, namely the palm and other fingers, grip or cradle the knife handle. In doing so, the user places the thumb and forefinger on either side or face of the knife blade on the back end of the blade while continuing to rest the palm and remaining three fingers on the handle. The pinch grip is considered to provide the user with better control over the knife and allows for a faster yet more precise cut.

However, gripping the back end of a blade can cause discomfort for some users, even causing blisters or sores on the side of the forefinger that is pressed against the back end and spine of the blade. Also, because the spine of the blade is flat and provides no support or grip, the fingers can easily slip, especially when wet or oily from food preparation, thus reducing control and potentially causing injury.

Knives have been modified in the past to improve the user's grip on the blade. For example, U.S. Pat. No. 7,302,760, entitled FOLDING KNIFE WITH DUAL-ACTION PISTON, describes a folding knife that has small notches near the base of the blade as well as a thumb tick with finger serrations on the spine of the blade to assist a user in opening and closing the knife. However, the sole purpose of these features is to assist the user with the minor movements of pinching the knife blade and extending or closing the folding knife blade, not for gripping the knife during use. Due to the small structure of the folding knife, the notches and thumb tick are designed to be gripped by a user's fingertips only, and these features are not suitable for extended use or for more strenuous use, such as when the user is chopping or dicing foods.

Chinese Patent Application Publication No. 201573219, entitled GRIP-HOLE TYPE DAILY KNIFE, describes a knife that has several holes near the base of the blade through which the user's fingers may be inserted to help grip the knife. However, inserting fingers through the knife blade to grip the knife itself can cause discomfort for some users, even causing blisters or sores on the parts of the fingers that are pressed against narrow internal edges of the holes.

U.S. Patent Application Publication No. 2002/0170184, entitled CONTROL SYSTEM FOR A HANDHELD TOOL, describes a control knob disposed on the back edge of the knife shaft or blade, and spaced apart from the handle, to create a finger gap, and describes methods including grasping the control knob and/or grasping the finger gap while loosely cradling the tool handle. However, the control knob may be inadequate to enable a user to accurately control the motion of the knife during hasty food preparation because the user's fingers can slip off the ball just as easily as slipping off the blade of the knife. In addition, the control knob may get separated from the knife and lost, thus rendering its advantages useless. Further, such knobs increase the outward angle of the user's gripping finger and, therefore, increase, rather than decrease, the strain on the fingers and hand.

U.S. Pat. No. 673,506, entitled GRIPPING HANDLE FOR TOOLS, describes a removable molded attachment to be disposed on the back edge or spine of a knife, which may be firmly grasped in the hand and against which a considerable amount of pressure may be exerted without tiring the fingers of the operator. The attachment may be hollowed out on one side to receive the user's thumb and may have a projection on the other side about which the user's forefinger may be bent during gripping by the user. However, this attachment may negatively impact the utility of the tool by interfering with space constraints and by colliding with large food items during a slicing and/or cutting motion. In addition, the attachment may get separated from the knife and lost, thus rendering its advantages useless. Moreover, when using this attachment, the user places his forefinger proximal phalanx (e.g., the part of the forefinger closest to the palm of the hand) against an edge at the knife's spine, which may cause blisters or sores to form. Thus, the attachment described does not account for the placement of the user's forefinger proximal phalanx.

Similarly, U.S. Pat. No. 490,577, entitled POT SCRAPER, describes a pot scraper whose upper portion is thickened and has prongs projecting therefrom whose adjacent edges are beveled so that the user's forefinger and middle finger may be extended with ease between the prongs, thus giving the user a very secure hold on the scraper. However, the prongs jut out from the surface of the pot scraper and may negatively impact the utility of the tool. In addition, the prongs may make holding the scraper uncomfortable during use, because the user's fingers constantly butt up against the prongs, which are designed not to comfortably hold the fingers but rather to maintain their position. Furthermore, this patent describes a three-finger grip for force, not a two-finger grip for control. Moreover, the grip described in this patent does not account for the placement of, or provide support for, the user's forefinger proximal phalanx.

U.S. Design Patent No. D22,439, entitled TABLE KNIFE, illustrates a configuration for a table knife having a blade edge and a blade spine, wherein the blade spine includes a broadened and concave portion for the tip of a user's forefinger. However, this configuration does not include components that may facilitate a user gripping the knife blade with both thumb and forefinger on both faces of the knife's blade, and only contemplates placement of the tip of the user's forefinger, as opposed to the proximal phalanx, to aid the user in exerting a downward force on the knife blade.

Similarly, U.S. Pat. No. 492,409, entitled KNIFE, describes a finger support, rest, or guard for knives, including a padded clip that is bent into a shape so as to clip onto the spine of a knife. The top and inside surfaces of the clip include cushions of a soft material, and the user's finger rests upon the flat top of the clip. However, the clip does not include components that may facilitate a user gripping the knife blade with both thumb and forefinger on both faces of the knife's blade, and only contemplates placement of the user's forefinger, as opposed to the proximal phalanx, to aid the user in exerting a downward force on the knife blade. Moreover, the clip is an attachment that is manufactured separately from the knife and may get separated from the knife and get lost, thus rendering its advantages useless.

In addition, U.S. Pat. No. 1,750,577, entitled KNIFE ATTACHMENT, describes a knife attachment having a spring clip for embracing the sides of the knife blade about the spine. The attachment includes spaced parallel jaws, oppositely outturned at their upper ends and formed lengthwise of the blade as a concaved surface, and further including along the top a central transversely convex ridge, against the top face of which pressure is applied by the user's finger and which provides a longitudinally extending abutment that serves as a gripping surface for the finger. This attachment allows the forefinger's proximal phalanx to rest on the spine of the blade in a manner perpendicular to the blade but does not allow the forefinger to engage the face of the blade, thereby creating an awkward grip. Furthermore, the attachment is manufactured separately from the knife and may get separated from the knife and lost, thus rendering its advantages useless.

Moreover, U.S. Pat. No. 6,502,314, entitled KNIFE HANDLE, describes a knife handle suitable for use in connection with a blade with proximal and distal side and top faces. The knife handle includes an elongate hand gripping member and a unitary proximal digital member. The digital member has side faces which overlie the proximal side faces of the blade and an arm which overlies the proximal top face of the blade. A thumb groove and a first finger groove are formed in the side faces respectively of the proximal digital member and an index finger groove is formed in the arm of the digital member. Unfortunately, a knife having such a handle cannot be gripped with the chef's grip, because the digital member would interfere with the user's thumb and forefinger pinching the base of the blade.

U.S. Pat. No. 9,889,573, entitled KNIFE WITH GRIP, by the inventor hereof, describes a knife grip having a forefinger grip or platform located on a first face of the blade, having a first forefinger guide, a second forefinger guide, and a forefinger retaining area configured to retain a first portion of a forefinger of a user. The knife grip also has a thumb grip located on the second face of the blade, having a thumb guide and a thumb retaining area configured to retain a thumb of the user. The knife grip further has a platform located on the blade spine, configured to provide support for a second portion the forefinger of the user.

There is an unsatisfied need in the art for greater safety and greater control of a handheld knife beyond what is provided by the grips currently available in the art. Precision and speedy culinary tasks require a knife handle that facilitates a positive grip, clear visibility of the cutting region, significant leverage, no obstructions and greater control in all directions. It is desirable to achieve such goals with a knife handle that enables the user to comfortably hold the knife in a preferred manner when chopping or dicing foods, namely by pinching the back edge of the blade with the thumb and forefinger while resting the palm on the handle. None of the knife grip designs currently in the art meet these needs.

Thus, there is a need for a handle for a handheld knife that provides a positive grip for safety, improved visibility of the cutting region, greater leverage for cutting power, and precise control in all directions. Such a control system would be useful for a variety of devices and handheld tools including utility and culinary knives.

SUMMARY OF THE INVENTION

Accordingly, it is an object of the present invention to provide a knife having a grip or platform that comfortably nestles the user's fingers. More specifically, it is an object of the present invention to provide a knife having a handle that comfortably nestles the user's thumb and forefinger in a form-fitting manner into the blade region.

It is an object of the present invention to provide a tool, such as a knife, having grip portions disposed on the handle that extend onto the base and/or the spine of the knife blade.

It is another object of the present invention to provide a knife having a grip on a handle that extends beyond the tang and bolster areas onto the base of the knife and onto the spine of the knife, wherein the grip is configured to securely hold the user's thumb and forefinger and that allows the user to comfortably hold the knife by pinching the base of the blade with the thumb and forefinger while resting the palm and the remaining three fingers on the base of the handle.

BRIEF DESCRIPTION OF THE DRAWINGS

The subject matter regarded as the invention is particularly pointed out and distinctly claimed in the concluding portion of this specification. The invention, however, both as to organization and method of operation, together with objects, features, and advantages thereof, may best be understood by reference to the following detailed descriptions when read with the accompanying drawings in which:

FIG. 2 shows an illustration, from a right-handed forehand view (FIG. 2A) and from a right-handed backhand view (FIG. 2B), of a user gripping a culinary knife with thumb and forefinger according to certain aspects of the prior art;

Figure 1:
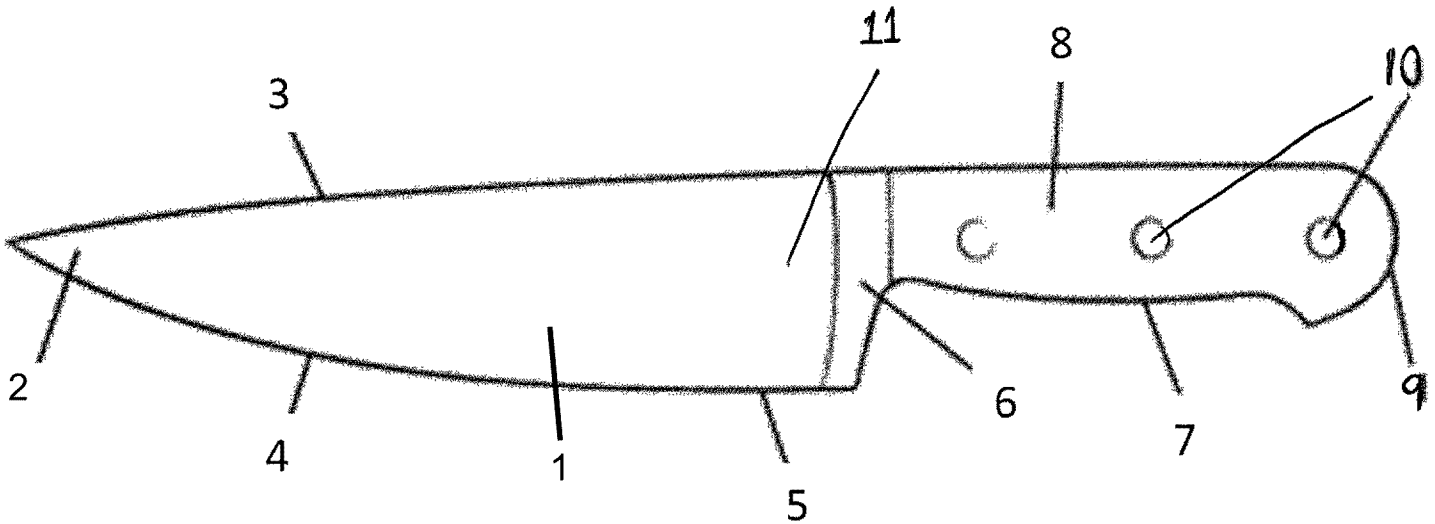
FIG. 1 PRIOR ART
FIG. 1 shows an illustration of a culinary knife according to certain aspects of the prior art.

It will be appreciated that, for simplicity and clarity of illustration, elements shown in the figures have not necessarily been drawn to scale. For example, the dimensions of some of the elements may be exaggerated relative to other elements for clarity. Additionally, the many features of any one embodiment shown in a figure should not be considered independent and separate from the features of an embodiment shown in another figure, and it is conceivable that features of any one embodiment may be combinable with another. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However, it will be understood by those of ordinary skill in the art that the present invention may be practiced without these specific details. In other instances, well-known methods, procedures, and/or components have not been described in detail so as not to obscure the present invention.

Referring now to FIG. 1, a knife that is used in the culinary arts (e.g., a chef's knife) typically has a blade 1 having two sides or faces and generally composed of a distal region or free end terminating in a tip 2 with a point, a proximal region having a base portion 11 with a heel 5, and a cutting region, between the proximal and distal regions, having a spine or back 3 opposing a cutting edge 4. A knife used in the culinary arts typically also has a handle 7 generally composed of a tang (not shown in FIG. 1) that extends backward from the blade and may be encapsulated within the material that forms the part of the handle 7 that is held by a user, e.g., slabs or scales 8, that may be sealed or attached, such as by rivets 10, and terminating at a butt 9. The knife may also have a bolster 6 situated between the blade and the handle. Other knife parts are contemplated, and each of the listed parts may have various sizes, shapes, weights, and/or configurations.

Generally, the spine 3 is the thickest, heaviest length of the blade and supports the entire blade. As the spine of the knife gets wider and thicker, the blade becomes stronger along its length. In many knives, the strongest portion of the blade is at the base region 11. Bolsters (e.g., front bolster 6) are designed to strengthen the blade in critical areas, such as at the blade and handle junction, or at the rear or butt of the knife in the case of a rear bolster.

FIG. 2 is an illustration of a knife being held using the pinch or chef's grip, viewed from both sides of the knife. FIG. 2A shows an illustration of this grip from a right-handed forehand view, and FIG. 2B shows an illustration of this grip from a right-handed backhand view. As depicted in FIG. 2B, the user's forefinger is placed against a first face of the base of the knife blade, and, as depicted in FIG. 2A, the user's thumb is placed against a second, opposing face, of the base of the knife blade, with the side of the user's forefinger pressed against the spine of the blade along the knife's first face. In order for the user to apply downward pressure during cutting, the proximal phalanx of the user's forefinger extends across or rests against the spine of the knife, and the user's palm rests on the knife handle while the user's middle, ring and small fingers are curled (e.g., wrapped around) around the knife handle.

In the pinch or chef's grip, the user's thumb and forefinger are held in place against the blade by friction based on the strength of the user's grip. When the blade becomes wet or oily, it can become slippery, thus requiring even greater strength and an even tighter grip in order to maintain an adequate hold on, and control over, the knife. As the user pinches the base of the knife with greater force to prevent slippage, the user's thumb and forefinger may tire quickly. In addition, when this grip is used, blisters and sores may form on the proximal phalanx of the user's forefinger due to the downward pressure exerted during the chopping/slicing motions by the forefinger's proximal phalanx, which extends across or is pressed against the knife's spine, which typically has a squared edge (with sometime rounded corners) despite being dull.

The extended-handle knife grip according to the present invention is intended to cure the above deficiencies. Specifically, the present invention provides a knife having an extended handle grip that comfortably holds the user's thumb and forefinger, and prevents the thumb and forefinger from slipping on the knife, when the user is holding the knife in the pinch or chef's grip as shown in, for example, FIG. 2.

In the present invention, in order to prevent the thumb and forefinger from slipping on the knife blade, the handle of the present invention is extended forward on one side and/or on top of the knife to provide the user with a gripping surface to securely hold the user's thumb and forefinger. In order to create the handle extension, in certain embodiments of the present invention, the knife's handle 7 may have an elongated slab or scale 8 on one side and/or on top of the handle 7 that extends forward onto spine 3 and/or base 11 of the knife.

In certain embodiments, additional material (e.g., plastic, ceramic or metal, or other materials) may be added to one side of the handle 7, co-extensive with the material of handle 7, either as part of the original structure or bonded or welded to that original structure, so as to project or extend forward onto the base 11 of the knife blade 1 on one side thereof, thereby providing a gripping surface for the user's thumb. In some embodiments, this handle extension may be shaped such that it provides a gripping surface for the user's thumb.

In addition, in certain embodiments, additional material (e.g., plastic, ceramic or metal, or other materials) may be added to the top of the handle 7, co-extensive with the material of handle 7, either as part of the original structure or bonded or welded to that original structure, so as to project or extend forward onto the spine 3 of the knife blade 1 to provide a proximal phalanx platform for the user's forefinger. In some embodiments, this handle extension may be concave shaped such that it conforms to the contours of the proximal phalanx of a forefinger.

Figure 3A:
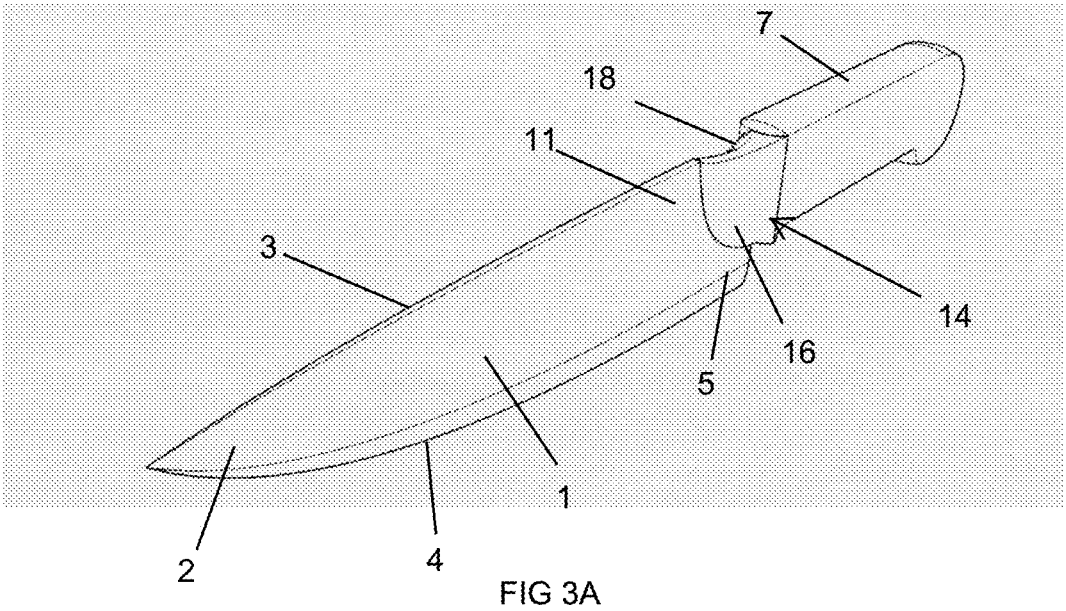
FIG. 3A is an illustration of a first side (e.g., from a right-handed forehand view) of a culinary knife having an extended handle grip according to certain aspects of the present invention.
Figure 3B:
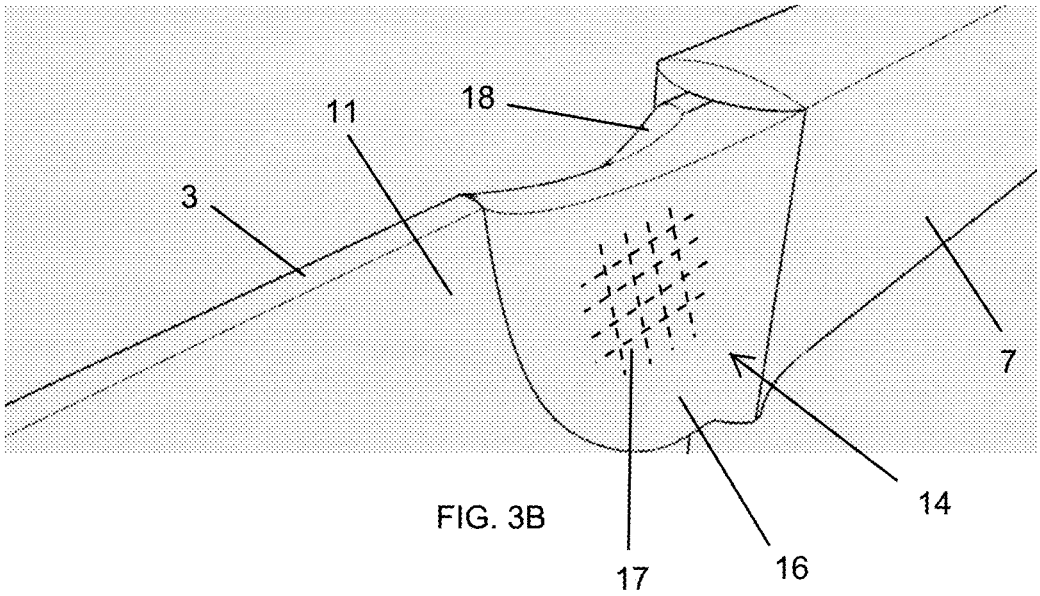
FIG. 3B is an illustration of a portion of the side of the culinary knife shown in FIG. 3A having an extended handle grip according to certain aspects of the present invention.

Reference is now made to FIGS. 3A and 3B, which are illustrations of a first side (e.g., from a right-handed forehand view) of a knife whose blade 1 has an extended handle grip according to certain aspects of the present invention. As depicted in FIG. 3A, when the blade is viewed from the right-handed forehand side, the grip includes a portion 14 of knife handle 7 that extends forward onto the base 11 of the blade 1 to form a thumb grip area 16 and a proximal phalanx platform 18. The portion 14 of knife handle 7 that extends forward onto the base 11 of the blade 1 also projects somewhat laterally away from the surface of the blade 1 in a perpendicular (e.g., transverse or horizontal) direction relative to the surface of the blade 1 (e.g., relative to the knife's longitudinal axis).

In a first embodiment, the portion 14 of knife handle 7 that extends forward onto the base 11 of the blade 1 may be formed as an integral extension of the handle 7, e.g., as one piece. In another embodiment, the portion 14 of knife handle 7 that extends forward onto the base 11 of the blade 1 may be a separate piece, e.g., one or more pieces in addition to knife handle 7, that is attached to the base 11 of the blade 1 by the addition of material via bonding or welding onto the forward edge of the handle 7. In either embodiment, the portion 14 of knife handle 7 projects forward from the handle 7 to form an extended portion 14 of the handle 7 that is appropriately shaped or contoured to grip a thumb and/or retain a forefinger within the contours of the extended portion 14.

In certain embodiments, as shown in FIG. 3B, thumb grip area 16 of portion 14 may include a surface 17 having an indentation formed therein thereof for the user to rest his/her thumb when gripping the knife, thereby preventing the user's thumb from slipping. In certain embodiments, thumb grip area 16 may also, or alternatively, have a surface 17 that is texturized or stippled to increase the coefficient of friction where contacted by the user's thumb and to aid the user in gripping the knife, thereby preventing the user's thumb from slipping. The texturizing or stippling in surface 17 may be stamped onto thumb grip area 16 or otherwise formed during the manufacturing process. However, in other embodiments, thumb grip area 16 prevents any thumb movement on the extended handle portion 14 without the need for any indented, texturized or stippled surface 17.

Thumb grip area 16 may also form a barrier adapted to prevent thumb movement during use. For example, thumb grip area 16 may be contoured to keep the user's thumb within thumb grip area 16 and to prevent thumb movement in a direction towards the knife's cutting edge 4 and heel 5. In certain embodiments, as shown in FIG. 3B, surface 17 of thumb grip area 16 has a contoured shape. In some embodiments, the contour of surface 17 of thumb grip area 16 is concave, so as to conform to the contours of the top and sides of the user's thumb when the thumb is in a position for holding the knife in the chef's grip (as shown, for example, in FIG. 2A). As a result, in certain embodiments, as shown in FIG. 3B, the curvature of surface 17 of thumb grip area 16 is configured to match the contour of the outward surface of the thumb (e.g., the contour of the thumb's distal phalanx).

The length and/or extension of thumb grip area 16 should be sufficient to prevent excess thumb movement, but not too large so as to create a burden when using the knife. In certain embodiments, the length of the thumb grip 16 may be from 1 cm to 6 cm long, or, more preferably, from 2 cm to 5 cm long. In certain embodiments, thumb grip area 16 may project away from the surface of the blade as an extension of the handle 7, e.g., approximately 0.25 cm to 1.5 cm, or, more preferably, approximately 0.5 cm.

In certain embodiments, thumb grip area 16 may extend on the base 11 of the knife's blade 1 from the knife heel 5 to the knife spine 3. Because only the distal phalanx, i.e., the tip, of the user's thumb is used to grip the knife in the chef's grip, the thumb grip 16 is generally located in an area closer to the knife spine 3, rather than in an area closer to the cutting edge 4.

Figure 4A:
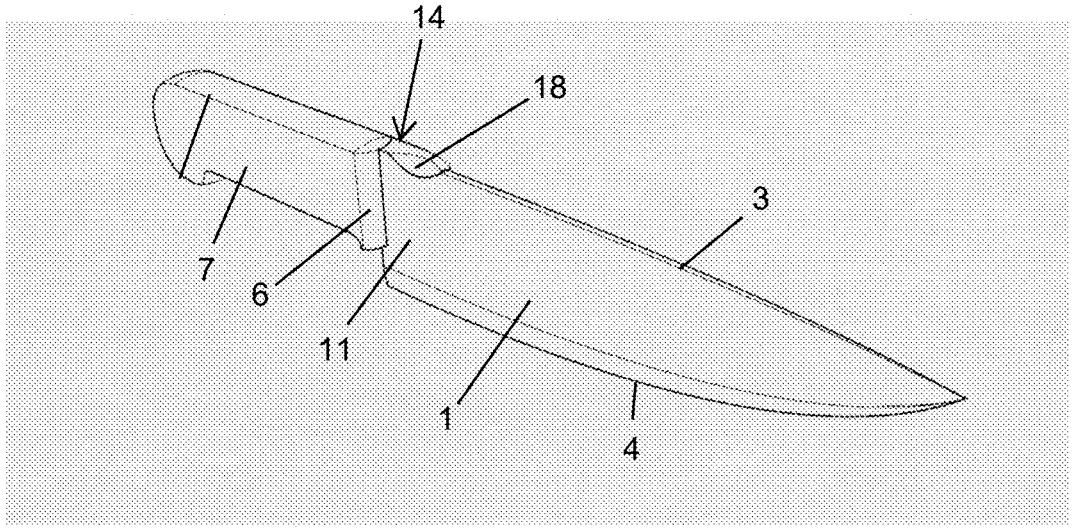
FIG. 4A is an illustration of a second side (e.g., from a right-handed backhand view) of a culinary knife having an extended handle grip according to certain aspects of the present invention.
Figure 4B:
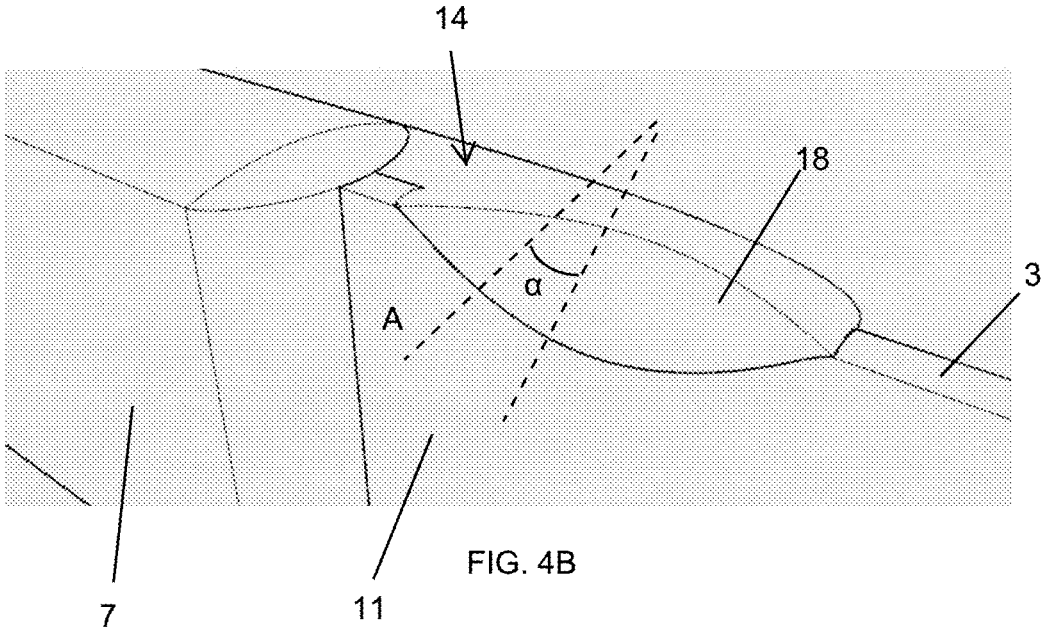
FIG. 4B is an illustration of a portion of the side of the culinary knife shown in FIG. AA having an extended handle grip according to certain aspects of the present invention.

FIGS. 4A and 4B are illustrations of the second side (e.g., from a right-handed backhand view) of the knife shown in FIGS. 3A and 3B whose blade 1 has an extended handle grip according to certain aspects of the present invention. As depicted in FIGS. 4A and 4B, the portion 14 of the handle 7 on this other side of the knife need not include a thumb grip 16, since the user's thumb is positioned on the forehand side of the knife, not the backhand side. However, as is clear from FIGS. 4A and 4B, the portion 14 of knife handle 7 that extends forward onto the base 11 of the knife also includes a proximal phalanx platform 18, as also shown in FIGS. 3A and 3B.

As shown in FIGS. 3A and 3B and in FIGS. 4A and 4B, the extended portion 14 of the knife handle 7 includes a platform 18 for accommodating the proximal phalanx of a user's forefinger (the portion of the forefinger closest to the palm of the hand), according to certain aspects of the present invention. As mentioned above, when a standard culinary knife is held in the pinch or chef's grip, the proximal phalanx of the user's forefinger extends across and exerts downward pressure upon the knife's spine, which makes the forefinger's proximal phalanx susceptible to blisters and sores during extended use.

The purpose of the platform 18 is designed to provide a comfortable platform for at least a portion of the forefinger's proximal phalanx to rest upon. Accordingly, as discussed below, platform 18 is preferably configured so as to conform to the contours of the proximal phalanx of a user's forefinger, the thumb-side of which rests on or against platform 18 when the user is holding the knife in the chef's grip.

Due to the anatomy of the hand, and the positioning of the user's fingers in the chef's grip, the proximal phalanx platform 18 is, in preferred embodiments, located on or alongside the knife spine 3, proximal to the base 11 of the blade (as depicted in FIG. 4A). In certain embodiments, platform 18 breaks the continuity of the knife spine 3 and is configured to support a portion of the user's forefinger (e.g., at least a portion of the forefinger's proximal phalanx). In some embodiments, the platform 18 is located below the edge of the spine 3, while in other embodiments, the platform 18 may be located above the edge of the spine 3, and in other embodiments, the platform 18 may be located alongside the edge of the spine 3. In certain embodiments, as will be discussed hereinbelow with regard to FIGS. 5A and 5B, the proximal phalanx platform 18 is formed into a notch 22 that is cut into the spine 3 of the blade 1.

In order to be conformed to the contours of the outside surface (e.g., thumb-side surface) of the proximal phalanx of the user's forefinger, the surface of platform 18 that supports the proximal phalanx portion of the forefinger is, in certain embodiments, curved and has a concave shape or contour complementary to the forefinger's outer (e.g., convex) surface, as illustrated in FIGS. 4A and 4B. As a result, the user's forefinger comfortably rests against and upon platform 18. In some embodiments, the surface or face of platform 18 opposing the concave surface (e.g., the surface on the forehand side of the grip) may have a convex shape or curvature. The curved shape of the outer edge of platform 18 in combination with the concave curvature of the surface of platform 18 may cause platform (38) to appear similar to a half of a spoon, i.e., a spoon sliced lengthwise, a half of an oval shape, or a quadrasphere (e.g., half of a hemisphere). Other shapes are also contemplated.

In certain embodiments, as shown best in FIGS. 3B and 4B, platform 18 may extend away from the knife spine 3 towards the forehand side of the knife and at an angle relative to the knife blade (e.g., along the knife's longitudinal axis). The angle $\alpha$ at which platform 18 extends downward towards the forehand side of the knife, as shown in FIG. 4B, corresponds to the angle at which the user's forefinger extends across the knife's spine 3 when a user grips the knife with the chef's grip, as shown in FIGS. 2A and 2B. In certain embodiments, the angle $\alpha$ at which platform 18 extends towards the thumb side of the grip is approximately 20 to 70 degrees relative to an axis A extending perpendicular to the face or side of the knife. In other embodiments, platform 18 extends at an angle $\alpha$ of approximately 30 to 60 degrees. In certain embodiments, platform 18 extends at an angle $\alpha$ of approximately 45 degrees. The angle and curvature of proximal phalanx platform 18 help ensure that the portion of the forefinger rests on the platform comfortably.

In a first embodiment, the portion 14 of knife handle 7 that extends forward onto the base 11 of the blade 1 may be formed as an integral extension of the handle 7 or may be attached to the base 11 of the blade 1 by the addition of material via bonding or welding onto the forward edge of the handle 7 of the knife, thereby projecting forward from the handle 7 to form an extended portion 14 of the handle 7 that is appropriately shaped or contoured to grip a thumb and/or retain a forefinger within the contours of the extended portion 14.

Figure 5A:
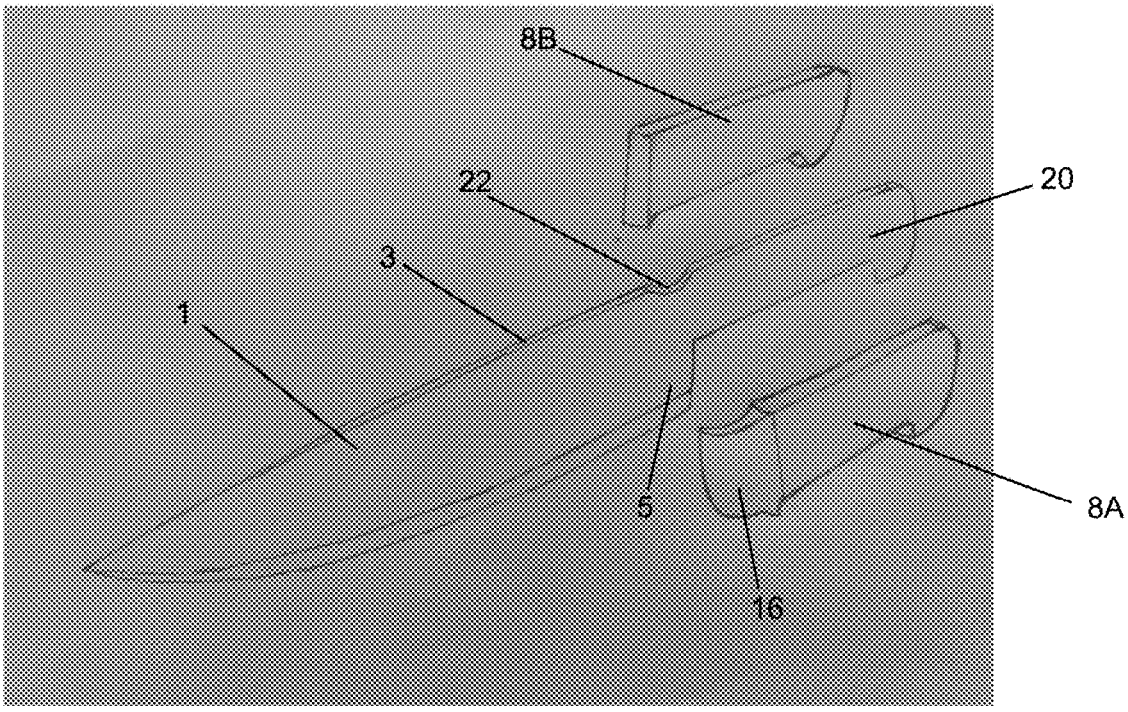
FIGS. 5A and 5B are illustrations, from a right-handed forehand view and a right-handed backhand view, respectively, of exploded perspective views of a knife having an extended handle grip according to certain aspects of the present invention.
Figure 5B:
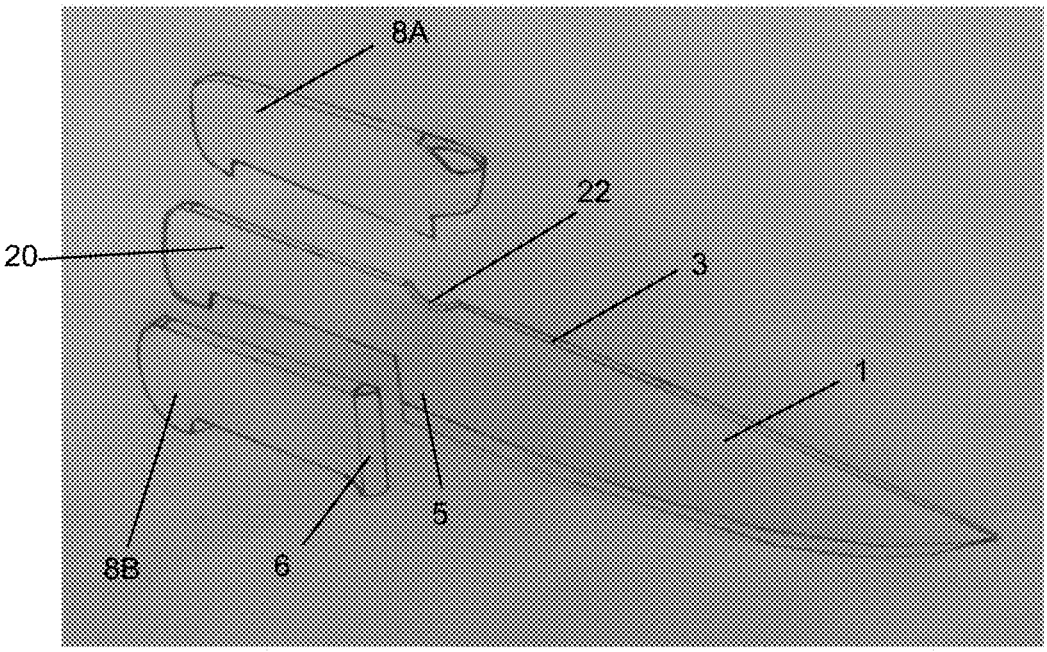

In certain embodiments, as shown in FIGS. 5A and 5B, in order to manufacture the handle 7 with the extended portion 14, a portion of the spine 3 of the knife, e.g., in a curved shape, such as an arc or the shape of a half oval, such as a notch 22, may be removed or cut out from the knife spine 3 during stamping of the knife. Alternative manufacturing methods include shaping the knife out of one block of material (e.g., metal) via, for example, CNC milling, or hardening the final shape out of metal powder via 3-D printing. Other alternative methods of forming the knife with a cut out are contemplated. Other alternative cut out shapes for notch 22 are contemplated, such as other geometric shapes, such as triangle, square, rectangle, pentagon, hexagon, octagon, etc.

Then, the slabs or scales 8A and 8B of the handle 7 are placed around the tang 20 that extends backward from the blade 1, so as to encapsulate the tang 20 within the slabs or scales 8A and 8B of handle 7, and are sealed or attached, such as by rivets 10. However, in certain embodiments, the two slabs or scales 8A and 8B of the handle 7 are not identical clam-shell pieces, but rather have a side 8A with an extended portion 14 and a side 8B without an extended portion 14. In certain embodiments, handle side 8A extends farther distally on its side of the blade 1 than handle side 8B does on its side of the blade 1. In one embodiment, the slab 8A of the handle 7 with the extended handle portion 14 has both the thumb grip area 16 that extends forward onto the forehand side of the base 11 of the knife and the proximal phalanx platform 18 that extends forward onto or alongside the spine 3 of the knife.

In one embodiment, the proximal phalanx platform 18 may be welded or bonded to the side of the blade 1 such that the proximal phalanx platform 18 is positioned against notch 22. In this embodiment, as can be seen in FIG. 5B, the bottom, curved edge of the proximal phalanx platform 18 is aligned along the curved edge of the notch 22 that is cut out of the spine 3. In certain embodiments, the external contour of the proximal phalanx platform 18 matches the notch 22 cut out of the spine 3.

In certain embodiments, the proximal phalanx platform 18 is positioned over notch 22. In this embodiment, the bottom, curved edge of the proximal phalanx platform 18 is press fit, friction fit or bonded into the curved edge of the notch 22 that is cut out of the spine 3.

In certain embodiments, each of the parts of the extended handle portion 14 of the present invention may be manufactured as a separate piece. In other embodiments, two or more pieces may be formed as one piece. In yet other embodiments, all of the parts of the handle 7 and its extended portion 14 may be made as one piece.

Figure 6A:
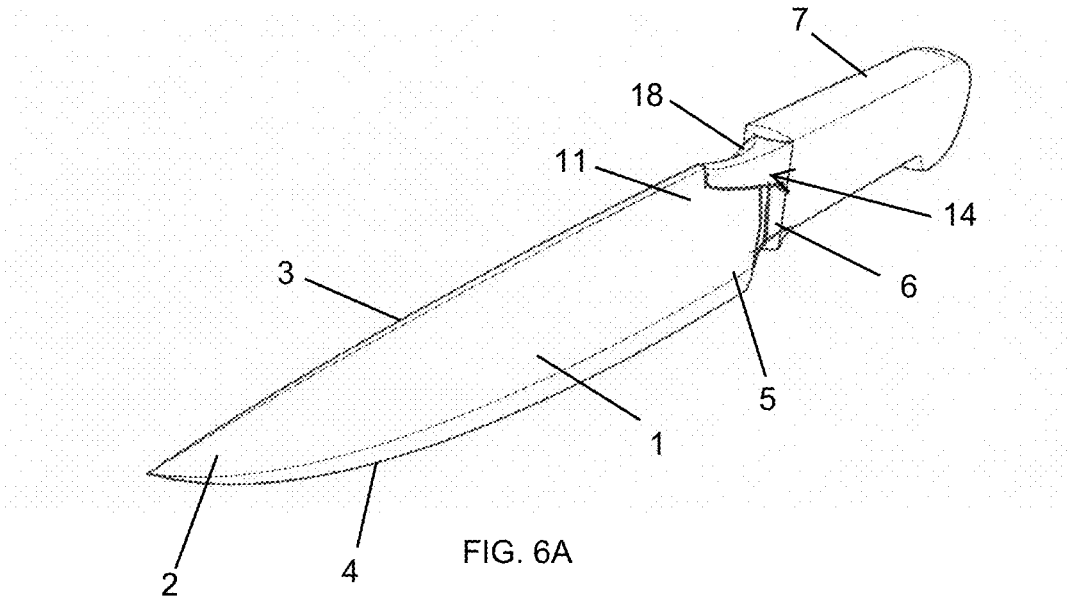
FIG. 6A is an illustration of a first side (e.g., from a right-handed forehand view) of a culinary knife having an extended handle grip according to another aspect of the present invention.
Figure 6B:
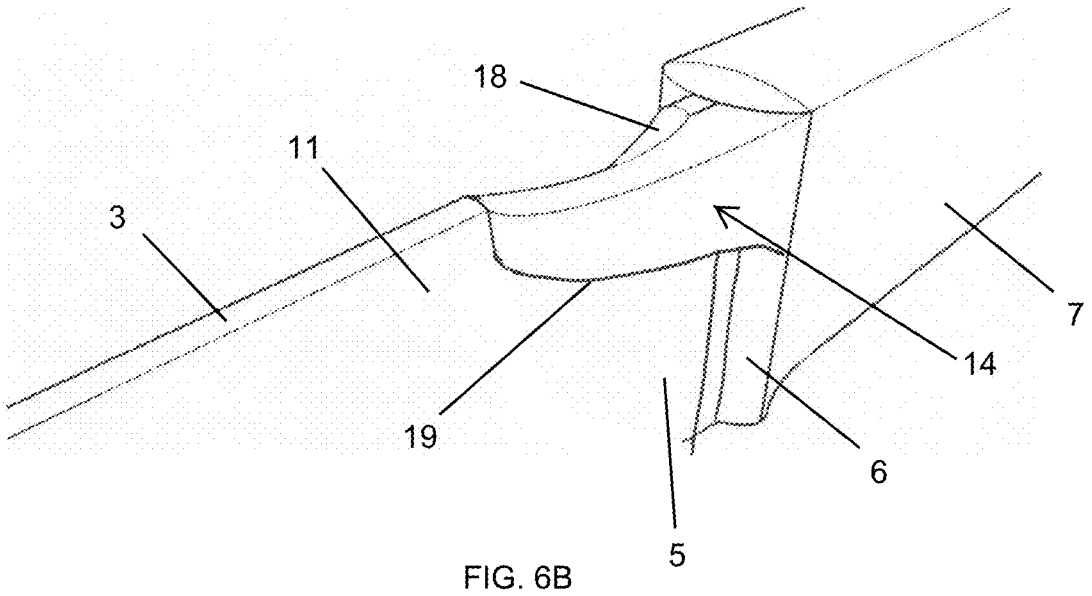
FIG. 6B is an illustration of a portion of the side of the culinary knife shown in FIG. 6A having an extended handle grip according to another aspect of the present invention.

Reference is now made to FIGS. 6A and 6B, which are illustrations of the first side (e.g., from a right-handed forehand view) of another embodiment of a knife whose blade has an extended handle grip according to certain aspects of the present invention. As depicted in FIG. 6A, when the blade is viewed from the right-handed forehand side, the grip includes an extended portion 14 of knife handle 7 that extends forward onto the base portion 11 of the blade 1 over the spine 3 to form a proximal phalanx platform 18, similar to the embodiment as shown in FIGS. 3A and 3B.

In this embodiment, however, the extended portion 14 of knife handle 7 that extends forward onto the base 11 of the blade 1 does not include a thumb grip area 16 with a surface 17, as shown in FIGS. 3A and 3B. Instead, as shown in FIGS. 6A and 6B, extended portion 14 of handle 7 extends forward onto the base 11 of the blade 1 only on the upper region of the base 11 of the blade 1, i.e., the region more proximal to the spine 3 than to the cutting edge 4, but not on the heel portion 5 thereof. In the absence of a thumb grip 16 area with surface 17, the lower edge 19 of extended portion 14 of knife handle 7 may serve as an abutment surface, such that the user may brace his/her thumb, e.g., at an edge thereof, against the lower edge 19. Alternatively, or in addition, the knife may have a bolster 6, as in prior art knives (see FIG. 1).

Figure 7A:
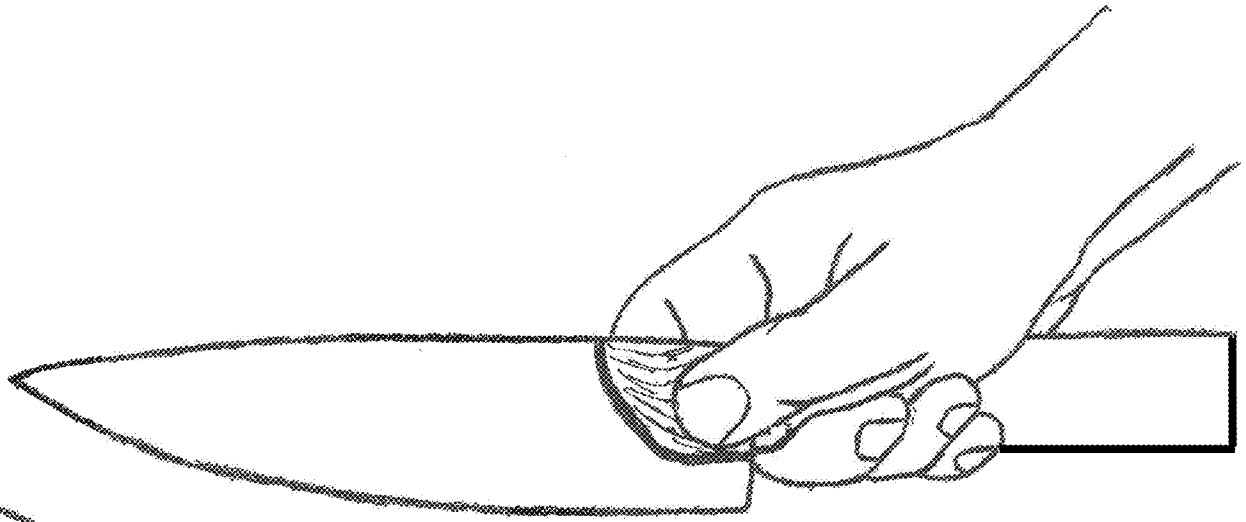
FIGS. 7A and 7B are illustrations, from a right-handed forehand view and a right-handed backhand view, respectively, of a user gripping a culinary knife having extended handle and grip according to certain aspects of the present invention.
Figure 7B:
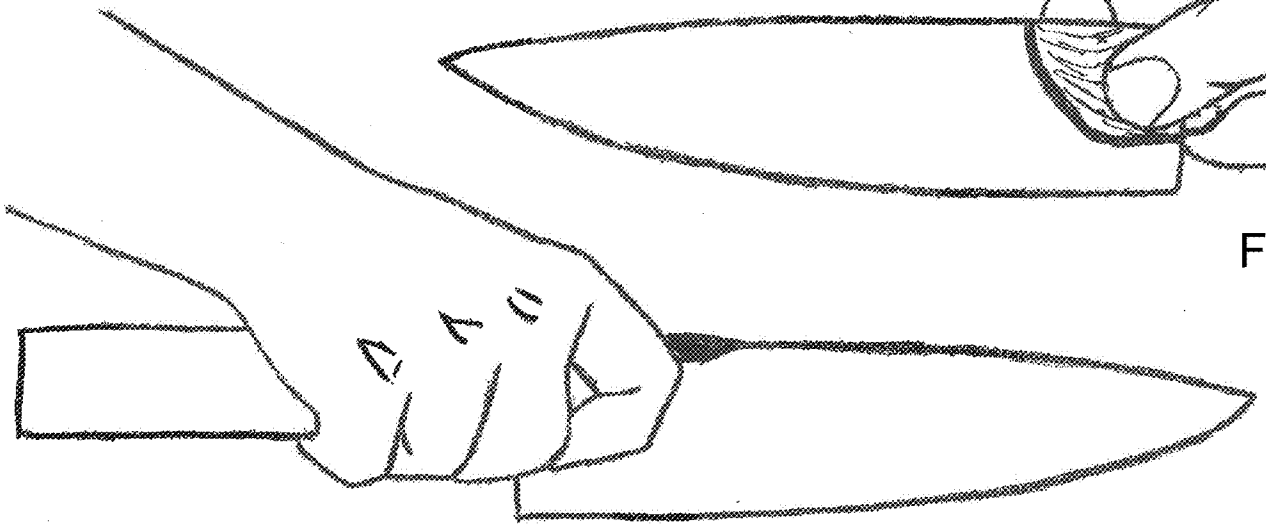

Reference is now made to FIGS. 7A and 7B, which are illustrations of a user's hand gripping a knife via components according to certain aspects of the present invention. FIG. 7A illustrates the right-handed forehand side of a user's hand gripping the knife, and FIG. 7B illustrates the right-handed backhand side of user's hand gripping the knife, showing the positioning of certain components of the present invention such as, for example, thumb grip area 16 and forefinger proximal phalanx platform 18.

As can be seen in FIGS. 7A and 7B, the user's thumb and forefinger rest on the extended handle portion 14 of the present invention, which is designed to comfortably fit the user's fingers. For example, and as discussed above, each component may have a form-fitting design adapted to securely and comfortably hold the user's fingers. Specifically, as shown in FIGS. 7A and 7B, the user's thumb rests squarely on the thumb grip area 16, and the proximal phalanx part of the user's forefinger rests squarely on the proximal phalanx platform 18.

In most embodiments, the grip of the current invention is asymmetrical (e.g., is chiral) due to that asymmetrical nature of the hand. It is contemplated that the grip of the present invention may be manufactured to be specific for users who use their right or their left hand when holding a knife, and an asymmetric version of the grip may designate the grip as either a right-handed grip or a left-handed grip. FIGS. 3-7 herein show the grip in a right-handed asymmetric version thereof, and the discussions herein have referred to a fore-hand-side and a backhand-side when held by a right-handed user, although a left-handed asymmetric version thereof is similarly contemplated by reversing the structures.

A symmetric version of the grip is possible. It is also contemplated that the grip of the present invention may be manufactured in an ambidextrous version, i.e., to allow users who use either or both their right or their left hand when holding a knife to use this grip. For example, a symmetric version may designate the bolster grip as ambidextrous.

It will be evident to those skilled in the art that the invention is not limited to the details of the foregoing illustrative embodiments and that the present invention may be embodied in other specific forms without departing from the spirit or essential attributes thereof.

The embodiments presented herein are, therefore, to be considered in all respects as illustrative and not restrictive of the scope of the invention, and the skilled artisan will appreciate the appropriate equivalents thereto, which are to be considered as part of this invention.

The invention claimed is:

1. A knife, comprising:

a blade with a first side, a second side, a surface forming a spine, an edge defining a cutting edge opposite the spine, a distal end and a proximal end;

a tang extending from the proximal end of the blade;

a notch formed in the spine, at the proximal end of the knife adjacent to the tang; and a first handle side and a second handle side that are configured to be joined together around the tang, wherein a portion of the first handle side extends farther distally on the first side of the blade than the second handle side does on the second side of the blade, such that the farther-extending first handle side portion forms an extension that has a thumb grip on the first side of the handle and a finger platform on a backhand side of the handle that extends over or alongside the spine and rests in the notch.

2. The knife according to claim 1, wherein the notch has a concave contour.

3. The knife according to claim 2, wherein the finger platform has a concave surface contour, and wherein the concave surface contour of the finger platform matches the contour of the notch.

4. The knife according to claim 1, wherein the finger platform has a surface that is angled downward relative to an axis extending perpendicular to the first and second sides of the blade.

5. The knife according to claim 4, wherein the finger platform surface is angled approximately 20-70 degrees relative to the axis extending perpendicular to the first and second sides of the blade.

6. The knife according to claim 4, wherein the finger platform surface is angled approximately 30-60 degrees relative to the axis extending perpendicular to the first and second sides of the knife.

7. The knife according to claim 4, wherein the finger platform surface is angled approximately 45 degrees relative to the axis extending perpendicular to the first and second sides of the knife.

8. The handle according to claim 1, wherein the first handle side comprises a thumb grip.

9. The handle according to claim 8, wherein the thumb grip comprises one or more of a texturized surface that is configured to provide a friction grip for a surface of a user's thumb, a concave contoured surface that is configured to provide a grip for a surface of a user's thumb, and an abutment surface that is configured to provide a brace for at least an edge of a user's thumb.

10. A knife, comprising:

a blade with a first side, a second side, a surface forming a spine, an edge defining a cutting edge opposite the spine, a distal end, and a proximal end, a tang extending from the proximal end of the blade;

a notch formed in the spine, at the proximal end of the knife adjacent to the tang; and a first handle side and a second handle side that are configured to be joined together around the tang, wherein a portion of the first handle side extends farther distally on the first side of the blade than the second handle side does on the second side of the blade, such that the farther-extending first handle side portion forms an extension that has a thumb grip on the first side of the handle and a finger platform on a backhand side of the handle that extends over or alongside the spine and rests in the notch.

11. The knife according to claim 10, wherein the notch has a concave contour.

12. The knife according to claim 10, wherein the finger platform has a surface that is angled relative to an axis extending perpendicular to the first and second sides of the blade.

13. The knife according to claim 12, wherein the finger platform surface is angled approximately 20-70 degrees relative to the axis extending perpendicular to the first and second sides of the blade.

14. The knife according to claim 12, wherein the finger platform surface is angled approximately 30-60 degrees relative to the axis extending perpendicular to the first and second sides of the blade.

15. The knife according to claim 12, wherein the finger platform surface is angled approximately 45 degrees relative to the axis extending perpendicular to the first and second sides of the blade.

16. The knife according to claim 12, wherein the finger platform has a concave surface contour, and wherein the concave surface contour of the finger platform matches the contour of the notch.

17. The knife according to claim 10, wherein the thumb grip comprises a texturized surface that is configured to provide a friction grip for a surface of a user's thumb.

18. The knife according to claim 10, wherein the thumb grip comprises a concave contoured surface that is configured to provide a grip for a surface of a user's thumb.

19. The knife according to claim 10, wherein the thumb grip comprises an abutment surface that is configured to provide a brace for at least an edge of a user's thumb.

* * * * *